United States Patent [19]

Johnson

[11] Patent Number: 4,464,551

[45] Date of Patent: Aug. 7, 1984

[54] ELECTRIC CIRCUIT CONTROLLING DEVICE AND METHOD OF OPERATING SAME

[75] Inventor: Ronald L. Johnson, Prophetstown, Ill.

[73] Assignee: General Electric Company, Fort Wayne, Ind.

[21] Appl. No.: 378,485

[22] Filed: May 14, 1982

[51] Int. Cl.[3] ..... H01H 35/34

[52] U.S. Cl. ..... 200/83 P; 200/81.4; 200/83 J; 200/83 S

[58] Field of Search ..... 200/81 R, 83 R, 83 P, 200/83 S, 83 SA, 67 DB, 67 DA, 5 A, 275, 83 WM, 81.4, 83 B

[56] References Cited

U.S. PATENT DOCUMENTS

| | | | |
|---|---|---|---|
| 3,133,170 | 5/1964 | Nanninga | 200/275 X |
| 3,153,708 | 10/1964 | Guthrie | 200/67 DA |
| 3,352,983 | 11/1967 | Cools | 200/83 WM |
| 3,996,429 | 12/1976 | Chu et al. | 200/5 A |
| 4,091,249 | 5/1978 | Huffman | 200/83 P |
| 4,330,695 | 5/1982 | Poling | 200/83 P |

FOREIGN PATENT DOCUMENTS

| | | | |
|---|---|---|---|
| 1962486 | 7/1970 | Fed. Rep. of Germany | 200/83 WM |

*Primary Examiner*—J. R. Scott

*Attorney, Agent, or Firm*—Joseph E. Papin

[57] ABSTRACT

The electric circuit controlling device has a snap acting member disposed in a housing and is adapted for successive discrete snap action motions from a stable configuration toward two unstable configurations. A pair of means are operable generally for switching between two circuit controlling modes and an actuating means is operable generally in response to the successive discrete snap action movements of the snap acting member for selectively operating the pair of switch means between the circuit controlling modes. A force transmitting means has at least two different force applying portions selectively associated in operating relation with the snap acting member to cause the successive discrete snap action movements from the stable configuration toward the two unstable configurations at different force levels. The device is provided with an adjusting arrangement wherein the magnitude of at least one of the two different force levels can readily be changed. A method of operating the electric circuit controlling device and a method of applying a calibrating force against the snap acting member are also disclosed.

27 Claims, 9 Drawing Figures

ELECTRIC CIRCUIT CONTROLLING DEVICE AND METHOD OF OPERATING SAME

FIELD OF THE INVENTION

This invention relates generally to electric circuit controlling devices and in particular to a controlled device especially adapted for use in electric circuits of vehicles and a method of operating such controlling device as well as a method for calibrating successive discrete snap action motions of a snap acting member of such devices.

BACKGROUND OF THE INVENTION

It is quite desirable to provide an improved yet inexpensive, rugged and flexible electric circuit controlling device having the capability to be used for a number of diverse applications with little change of components. In addition, the device should be able to control selectively multiple electric circuits even under adverse operating conditions. For example, it is quite desirable to provide an improved circuit controlling device that is sturdy enough to be employed in vehicles, such as automobiles. In one application where the vehicle is equipped with a hydraulic boost power brake system, the device should control the cycling of a hydraulic pump for maintaining a specified pressure in the boost chamber. If this pressure falls below a critical point, the control then turns on a warning light on a dashboard. With very little change in components, if any, the device could also be used for another multiple circuit controlling application in which the vehicle has an air conditioning system. The device would be connected into the high side of the air conditioning system and could be capable of opening and closing a fan circuit of that system as well as switching the fan between low and high speeds. Further it would be especially desirable to incorporate in such multiple circuit controlling devices, a low cost but highly effective single snap acting arrangement which could operate with at least two snap actions for operating two switches at different settings to accomplish the multiple circuit controlling functions. This should be attained by an arrangement that has an enhanced life expectancy and is reliable in operation. Further, it would be further desirable that the device incorporate an improved way to calibrate the forces in the snap acting arrangement.

SUMMARY OF THE INVENTION

Among the several objects of the present invention may be noted the provision of an improved electric circuit controlling device, of a method of operating the device, and of a method of cablibrating certain components of the device which at least in part incorporate the above-discussed advantageous and desirable features. Another object of the present invention is to provide an improved electric circuit controlling device and method of operating the same in which the device incorporates a single snap acting member capable of operating with at least two snap actions for actuating two switches having different settings. It is a further and more specfic object to provide a device having a snap acting arrangement with improved operating characteristics between a stable configuration and at least two unstable configurations at different force levels for controlling actuation of at least two switches. Further objects include the provision of such improved device and method in which the range of forces necessary to effect operation of the snap acting arrangement between stable and unstable configurations may be more readily and accurately attained and controlled; and the provision of such improved device and method employing component parts which are simple in design, economical to manufacture, and eay to assemble. These as well as other objects and advantageous features of the present invention will become apparent and are pointed out hereinafter.

In carrying out the objects, in one form, a device is furnished with snap action means disposed in a housing and adapted for successive discrete snap action movements at least at two different force levels, from a stable configuration toward a pair of unstable configurations. A pair of switch means operable generally for switching between two circuit controlling modes is also incorporated in the housing as well as an actuating means operable generally in response to the successive discrete snap action motions of the snap action means for selectively operating the pair of switch means between circuit controlling modes. Force transmitting means having at least two different force applying portions selectively associated in operating engagement with the snap acting means cause the successive discrete snap acting movements from the stable configuration towards the two unstable configurations at different force levels so as to affect the operation of the actuating means and the selective actuation of the pair of switch means between the circuit controlling modes. The housing also includes adjustable turnable means associated with the snap action means for adjusting at least two of the force levels of the snap action motion of the snap action means, with the adjustment by the turnable means of one of the at least two force levels being greater than the adjustment of another of the at least two force levels.

Regarding a method of operating the snap action means through successive discrete snap action movements from a stable configuration toward a pair of unstable configurations, the snap action means has a peripheral portion seated at least in part in engagement with a seat provided in the housing. The method comprises the steps of exerting an applied force at a preselected level onto the snap action means. The snap action means is moved in response to the applied force at the preselected level exerted thereon though one of the discrete snap action movements from the stable toward the unstable configurations. The applied force, exerted on the snap action means, is increased to another preselected level greater than the first named preselected level, and the snap action means is moved by virtue of the increased force through another discrete snap action movement toward another unstable configuration.

The method of calibrating the successive discrete snap action movements includes applying a calibration force against the snap action means generally in opposition to its successive discrete snap action movements, with the calibration force having a greater affect during the successive discrete movement between two unstable configurations than between the stable and one of the unstable configurations.

With the above arrangement and methods the heretofore identified desirable features and advantages are obtained. In particular, the range of forces necessary to effect satisfactory operation of the snap acting arrangement between its stable and at least two unstable configurations may be more readily and accurately achieved. Also the design is simple, the device economical to manufacture, components easily assembled, and operation quite effective. Furthermore, the device is capable of satisfactory multiple circuit contrl for a number of different applications with the minimum change of components.

The subject matter which I regard as my invention is particularly pointed out and distinctly claimed in the concluding part of this specification. My invention, however, both as to organization and method of operation, together with further objects and advantages thereof, may be best understood by reference to the following description taken in conjunction with the accompanying drawings.

BRIEF DESCRIPTION OF THE DRAWINGS

Corresponding reference characters indicate corresponding parts throughout the several views of the drawings.

The exemplifications set out herein illustrate the preferred embodiments of the invention and such exemplifications are not intended to be construed as limiting the scope of the disclosure or of the invention in any manner.

DETAILED DESCRIPTION OF THE DRAWINGS

Referring now to drawings in general and in regard to FIGS. 1 through 7 inclusive in particular there is illustrated the preferred form of the invention as incorporated in an electric circuit controlling device 11 in the application of controlling multiple electric circuits, by way of example only, of a vehicle (not shown) that has been equipped with a hydraulic boost power brake system.

Figure 4:
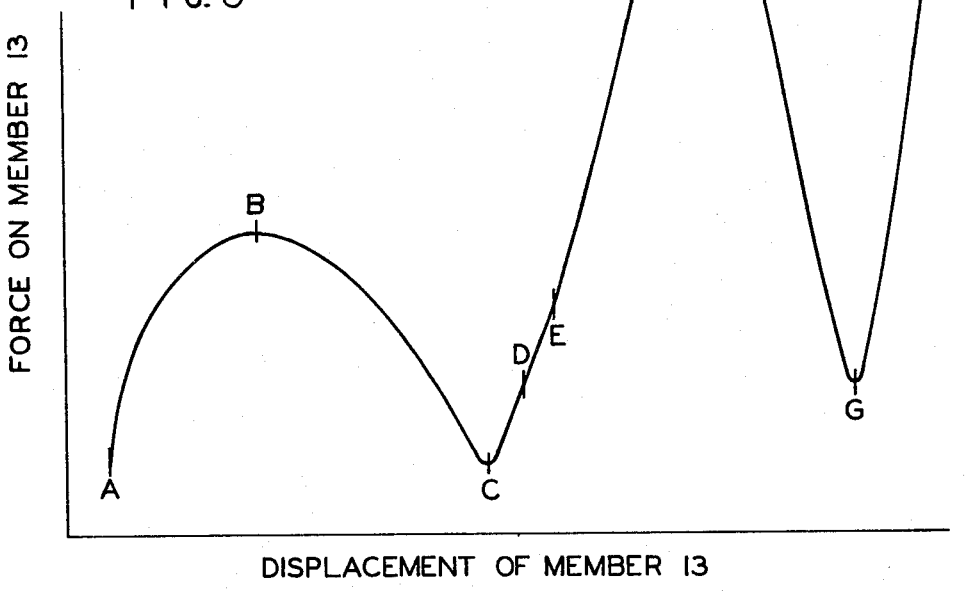
FIG. 4 is a force-displacement curve revealing one type of interaction attainable by force transmitting and snap acting components of the device illustrated in FIGS. 1 and 2.
Figure 5:
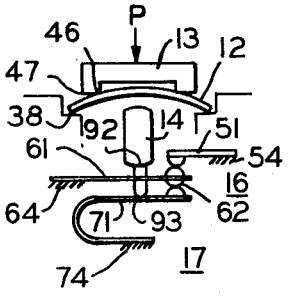
FIG. 5 is a schematic presentation of the force transmitting, snap acting, switch actuating and two switch components of the electric circuit controlling device of FIG. 1, the view illustrating the components in a stable configuration with the switch elements of the two switches being respectively in closed circuit modes.
Figure 6:
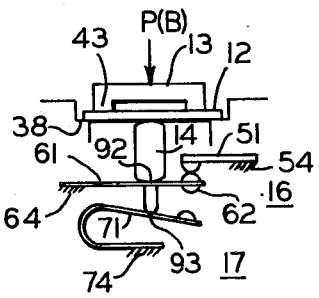
FIG. 6 is a schematic presentation of the components seen in FIG. 5, the components being shown in an unstable configuration with the switch elements of the upper switch (as viewed in the drawings) still in the closed circuit position while the switch elements of the lower switch having been operated to an open circuit mode.

In the illustrated exemplification the device incorporated a snap action means in the form of a snap acting means, such as for instance a snap acting disc or snap acting member 12, which is adapted for successive discrete snap action movements involving a plurality, i.e., at least two, different and distinct force levels from a stable slightly bowed configuration (FIGS. 1 and 4) toward a plurality, i.e., at least two, unstable configurations (FIGS. 5 and 6). The member may be built or shaped into the stable configuration seen in FIG. 1 from a generally thin strip of material well known in the art. While the particular shape and form of snap acting member 12 is illustrated for purposes of disclosure, any snap acting member of various different shapes and forms having the desired force characteristic may be utilized within the scope of the invention so as to meet at least some of the objects thereof. A force transmitting member 13 is movably carried in the device for reciprocating motion in force applying relation to one side of snap action member 12 which in turn operates a slidably mounted actuator 14, made for instance from "Textolite", in response to movement of member 12 for selectively operating switch means, such as a plurality or a pair of switches 16 and 17 between open and closed modes thereby controlling an electrical circuit associated with each switch.

Figure 2:
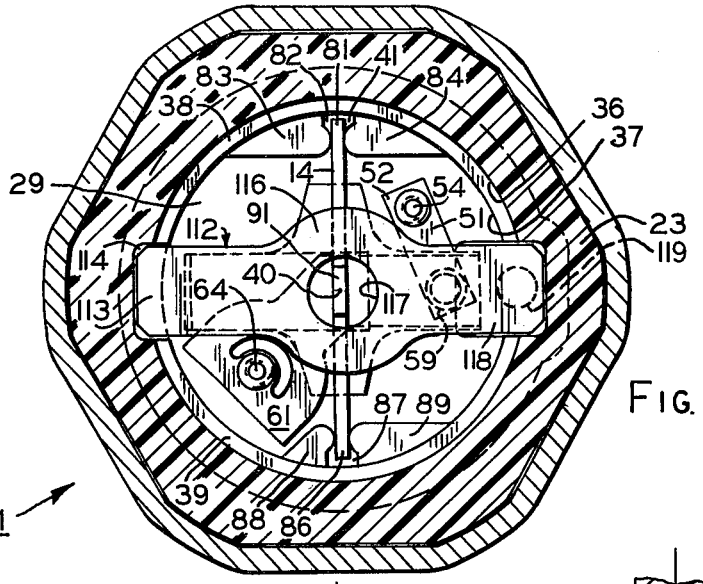
FIG. 2 is a sectional view taken along line 2—2 of FIG. 1.
Figure 1:
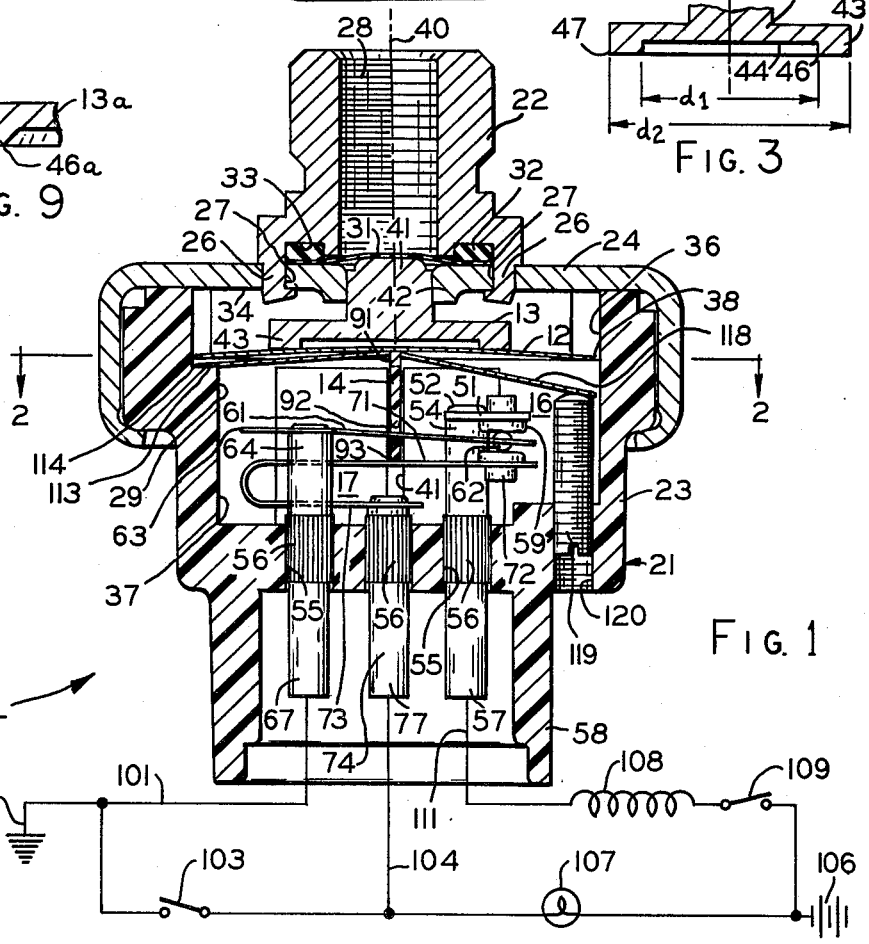
FIG. 1 is a view, partially in section and partially schematic, illustrating one form of the invention incorporated in an electric circuit controlling device, by way of example, for use in control of electric circuits of a vehicle (not shown) equipped with a hydraulic boost power brake system.

Device 11 of the exemplification and with particular reference to FIGS. 1 and 2 includes a housing 21 defined by an upper and enlarged lower (as viewed in the FIGS.) housing members or portions 22, 23, with a metallic sleeve 24 or other suitable means connecting housing portions 22 and 23 together in assembled relation. Sleeve 24 and the manner it is attached to the housing portion 23 are more fully disclosed in the Ronald W. Poling U.S. Pat. No. 4,330,695 issued May 18, 1982 which disclosure is incorporated herein by reference. A plurality of angularly spaced integral projections 26 on housing portion 22 detachably fit into accommodating holes 27 in sleeve 24 for this purpose. It is understood, of course, that housing portions 22, 23 and sleeve 24 may be built of any suitable material, such as resin, a metal or metal alloy, for instance, depending upon relative material costs and the application environmental requirements for device 11. For the illustrated vehicle application, housing portion 22 as shown is made from rust resistant metal and housing portion 23 from thermoresponsive material.

In view of the kind of application for device 11, that is, responsive to pressure in a boost chamber of a vehicle hydraulic boost power brake system (not shown), housing portion 22 incorporates a fluid chamber 28 adapted to be connected with a source of variable control pressure of that system. Fluid pressure responsive means in the form of a resilient or flexible diaphragm 31 of any suitable material, for instance, multiple layers of thin material coated with "Teflon" from du Pont, is sealably interposed between upper fluid chamber 28 and a lower switch chamber 29 constructed in housing portion 23. An O-ring seal 32, fitted in an annular slot 33 in housing portion 22 and with a wall 34 of sleeve 24, assists to provide this sealed relation.

Referring now more specifically to switch chamber 29, it has a plurality of walls 36, 37 having generally cylindrical shapes joined by arcuate shaped opposed ledges or shoulders 38, 39 which extend generally coaxially about a vertical center line 40 of device 11 in a plane perpendicular to walls 36, 37 to provide circular seats for supporting snap acting member 12. The force transmitting means 13 is operably arranged between diaphragm 31 and the upper surface of snap acting member 12 by guidably mounting an upper cylindrical section 41 of member 13 for reciprocating movement in a centrally flanged opening 42 through wall 34 of sleeve 24 along the vertical center of device 11 with the top surface of section 41 being in engagement with and responsive to movement of the diaphragm. The force transmitting means has a lower and enlarged section 43 having a central recess 44 facing snap acting member 12, section 43 being in force transmitting relation to the snap acting means member with force transmitting member 13 being mounted to effect motion similar to a postion. The force transmitting member 13 or piston in the illustrated embodiment may be constructed of any suitable material, such as aluminum. When snap acting member 12 is in the stable configuration such as that shown in FIG. 1, an inner angular region 46 in the form of a circular edge or the like (FIG. 3) will be in pressure applying engagement with member 12 to produce snap acting movement thereof. At other times as will become more apparent from the discussions hereinafter, an outer annular region 47, also of circular configuration and concentric with region 46 in the illustrated embodiment of FIGS. 1 and 3, has a greater diameter and hence a higher degree of pressure applying force than that of region 46. It thus will be in pressure engagement with the same member 12 but at a different but predetermined location on member 12 outwardly from that provided by region 46 to produce snap acting movements in the unstable configurations of member 12.

It will be recalled that there are two circuit controlling switches 16, 17 in device 11, and FIGS. 1 and 2 reveal the details of these switches. The upper (as viewed in the FIGS.) switch 16 has an upper fixedly disposed switch electric conductive element 51 secured for example as by staking 52 at one end to an upright terminal post 54 located in switch chamber 29. The post extends through an opening 55 in housing portion 23 and is attached thereto by a knurled construction 56. An end 57 of post is exposed externally of the housing 21 for connection into an electric circuit and is disposed in an annularly shaped terminal receptacle 58 for protection thereof. A contact 59 is carried by the free end of fixed contact element 51 and is disposed in circuit making and breaking relation with a flexible leaf spring type movable contact element 61 having a double contact 62 formed in its free end. The other end 63 of element 61 is staked to another upright terminal post 64 which also extends through a suitable opening in the housing with its end 67 also located in receptacle 58 for connection to an external electric circuit. Contact element 61 also forms a part of lower switch 17 and therefore is a common element to both switches. Switch 17 includes a generally U or J shaped movable leaf spring like electrically conductive contact element 71 with a contact 72 formed at its free end mounted to be in make and break relation with the bottom double contact 62. Its other end is staked to a short terminal post 74 which projects through the housing wall to expose an end 77 in receptacle 58 for external circuit connection. All three posts 54, 64, 74 may be firmly secured to housing 21 by a knurled construction 56 already identified. Switch elements 61 and 71 are thus both mounted in switch chamber 29 such that they are each biased upwardly toward snap acting member 12 when in their unoperated or at-rest positions. Thus, in this arrangement of parts switch element 51 and the upper contact of movable switch element 61 in effect define switch 16 while the bottom contact of switch element 61 and the movable contact element 71 in effect define switch 17, both switches having their contacts in the normally closed positions (FIGS. 1 and 5) and are adapted for circuit controlling positions or conductive modes in which the contacts are respectively made and broken with forces as will be seen later, applied independently of one another in the respective switches.

In order to accomplish the actuation of the two switches in response to the operation of the snap acting member 12, actuator 14 is mounted for slidable reciprocating movement by having one side 81 thereof disposed in a slot 82 formed by a pair of opposed upright walls 83, 84 in the switch chamber 29 and another opposite side 86 of the actuator slidably received in a slot 87 formed by integral walls 88, 89. Generally actuator 14 is formed as disclosed in the W. K. Anderson et al U.S. Pat. No. 4,054,767 issued Oct. 18, 1977 except that the upper part of the actuator has an extension of reduced cross section 91 which is operatively associated in actuating engagement with the underside of snap acting member 12. A transverse shoulder 92 in a horizontal slot open toward opposite side 86 of actuator 14 is adapted to make engagement with the upper surface of switch element 61 while a lower transverse edge 93 of the actuator is adapted to make similar engagement with switch element 71. In the relative positions and dimensions of the switch elements and of actuator 14 are such that when snap acting member 12 is in the stable mode or configuration thereof prior to being operated by transmitting member 13, reduced section 91 of actuator 14 is in engagement with snap acting member 12 while shoulder 92 is slightly spaced from the upper surface of movable switch element 61. The bottom edge 93 of actuator 14 is preferably in engagement with the upper surface of switch element 71 such that with the arrangement best seen in FIGS. 1, 5–7 inclusive for the first part of the travel downward of actuator 14, there is a lost motion in regard to the upper switch but not with respect to the lower switch which will be operated first. Continued downward movement as best seen in FIG. 6 of actuator 14 first opens switch 17 by moving switch element 71 away from switch element 61. Thus, while elements 61 and 71 are in open circuit relation, elements 61 and 51 are still in closed circuit positions. Continued downward movement of actuator 14 forces the opening of switch elements 51, 61, to the relative positions seen in FIG. 7, with switch elements 61, 71 still being maintained in open circuit relation.

With the above multiple circuit arrangement of switches 16, 17, device 11 is readily adapted for use in controlling the cycling of a hydraulic pump for maintaining a specified pressure in a specified pressure in the boost chamber in the power brake system. FIG. 1 shows a schematic circuit diagram for this application in which terminal post end 67, common to both switches 16 and 17, is connected by a lead 101 to a ground 102. A fluid level switch 103 is in circuit between ground 102 and terminal post end 77 by a lead 104. A vehicle battery 106, dashboard warning light 107, hydraulic pump relay 108 and ignition switch 109 are in circuit between terminal post ends 57 and 77 by a pair of leads 104, 111. These exemplary vehicle circuits do not form a part of the present invention and will not be further discussed, and are included to show the versatility of application of the form of device 11 illustrated by FIGS. 1–7 inclusive.

For calibrating the successive discrete snap action movements of member 12 adjustably movable means is provided in device 11 and associated with the snap action means for adjusting at least two of the force levels of the snap action motion. As shown, the adjustably movable means includes resilient means, such as a somewhat flexible relatively thin strap 112 having spring-like characteristics carried in the switch chamber 29 beneath snap acting member 12 as viewed in FIG. 1. One opposite end or end 113 of the strap is seated on ledge 114 provided slightly below and angularly between seats or housing shoulders 38 and 39 beneath snap acting member 12 in slightly spaced relation with it. An intermediate or generally central section 116 of the strap is enlarged and has a central opening 117 accommodating reduced section 91 of actuator 14. At least an angular part of the circumferential edge around central section 116 makes pressure contact with the under surface of snap acting member 12 at least generally adjacent a generally central portion thereof. The other opposite end or end section 118 of strap 112 remote from section 113 thereof depends away from snap acting member 12 and is engaged by the end of a turnable or adjustable means, such as screw 119 or the like for instance adjustably or threadably received in threaded opening 120 provided through housing portion 23. The opening is preferably between chamber 29 and the external surface of the housing to permit access to screw 119 from outside device 11. Screw 119 through its contact with depending section 118 of strap 112 maintains central section 116 of the strap in pressure engagement with the underside of snap acting member 12 and controls the degree of force applied at that central location to snap acting member 12. With this arrangement it will be observed that turntable means 119 is also located outwardly from the switch elements in switch chamber 29 and calibration may be achieved readily by turning the screw with a screwdriver in the desired direction to reduce or increase pressure on the snap acting member 12. Member or strap 112 may be built of any suitable material, for example, stainless steel having a thickness of 10 mils. Since the location at which central section 116 applies force or snap acting member 12 is radially inward from the locations on member 12 where it is acted upon by pressure applying regions 46, 47 of member 13, its effect on the magnitude of the forces is less than the forces applicable to either regions 46 or 47. Adjustment of screw 119 does, however, provide an adjustment of force levels at which snap acting member 12 operates wherein the calibration force will have a greater effect during successive discrete snap action movement of the snap acting member between its unstable configurations than during the successive discrete snap action movement of the snap acting member between the stable configuration and one of the unstable configurations. This will be considered in more detail hereinafter.

Figure 3:
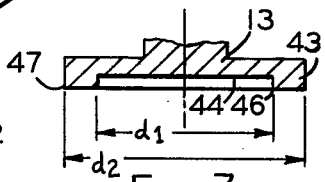
FIG. 3 is an enlarged partial view in cross section of the force transmitting component of the device shown in FIG. 1.

Certain advantages and beneficial featues of the present invention may be more readily understood from the description of the operation of device 11 and referring in particular to FIGS. 1 and 4–7 inclusive. It will be recalled that FIGS. 1 and 5 show the various components of device 11 with snap acting member 12 being in the stable configuration when the fluid pressure in chamber 28 is at a low value. Switches 16 and 17 will both be in closed circuit positions in their unoperated modes. As the fluid pressure increases in chamber 28, the increase will be transferred to force transmitting member 13 via diaphragm 31 and section 41 thereby moving member 13 away from chamber 28 and towards actuator 14 in switch chamber 29. The force initially established by the fluid pressure in chamber 28 acting on the effective area of diaphragm 31 and applied onto transmitting member 13 is indicated by a force arrow P in FIG. 5. In the stable configuration, at least the generally control portion of snap acting member 12 will be generally dome shaped with the inner circumferential edge or pressure applying region 46 of force transmitting member 13 being in engagement with the upper surface of snap acting member 12 at a location having a diameter d1 as seen in FIG. 3. Continued downward movement of member 13 will cause snap acting member 12 to change from its stable configuration and move toward the first of its unstable configurations. Thus, force transmitting member 13 will be moved in a creeping manner from zero displacement through position or point A to B on the curve of FIG. 4 where snap acting member 12 is caused to snap by pressure applying region 46, moving member 13 through points C and D on the curve. The force arrow P(B) in FIG. 6 indicates the force or force level at which the snap action movement of snap action member 12 toward the first of its unstable configurations is initiated and, of course, may be correlated with point B on the curve of FIG. 4. This snap action moves actuator 14 to the position shown in FIG. 6 where the bias of switch element 71 is overcome thereby moving that element downwardly and away from element 61 to open the circuit controlled by switch 17. The switch elements or switch 16 are still in closed circuit relation by virtue of the lost motion connection between the actuator and switch element 61.

Figure 7:
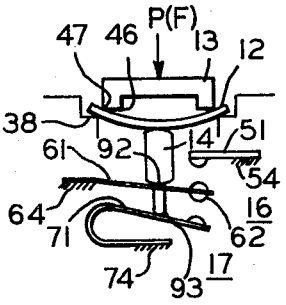
FIG. 7 is a schematic presentation of the components seen in FIG. 5 in another unstable configuration, with the switch elements of both switches being in open circuit modes.

As the fluid pressure continues to increase in chamber 28, the force on force transmitting member 13 is increased, causing the member to creep from position E to F where, at a force level greater than that at point B, a second snap action motion independent of the first one occurs, member 13 moving through position G to H on the curve in FIG. 4 and snap acting member 12 assumes the unstable configuration schematically seen in FIG. 7. The force arrow P(F) in FIG. 7 indicates the increased force or force level at which the second successive discrete snap action movement of snap action member 12 is initiated and, of course, may be correlated with point F on the curve of FIG. 4. This in turn causes actuator 14 to move swiftly to the location also schematically revealed in FIG. 7 where it has overcome the combined bias of both switch elements 61, 71 thereby maintaining switch 17 in open circuit while placing the upper switch 16 also in an open circuit position. As seen from the curve in FIG. 4, the force levels at F and H are higher than at B and E, easily overcoming the combined bias of switch elements 61, 71.

Conversely, as the force on force transmitting member 13 is decreased, as by a reduction in pressure in fluid chamber 28, the force transmitting member creeps from position H to G and snaps to position D through F to close switch 16 but not switch 17 (FIG. 6). As the force is further decreased, member 13 creeps from position D to C and then snaps to position A where snap acting member 12 is returned to its stable configuration (FIGS. 1 and 5) and switch 17, like switch 16, is again operated to the closed position. It should be noted at this time that in the relative positions of actuator 14 and switch elements 61, 71 shown in FIG. 7, both elements being biased away from their normally closed positions, they tend to apply a combined force on actuator 14 in a direction toward snap acting member 12 to move the actuator upwardly as member 12 is operated. In the relative positions of these components illustrated in FIG. 6, the force on actuator 14 in the direction toward member 12 is supplied by switch element 71.

It will be recognized from the above that by employing two distinct and spaced apart pressure applying regions 46, 47 in cooperation with snap acting member 12, the ratio of the force of force transmitting member 13 to the snap acting member force is changed during the operation of member 12. By the proper selection of d1 and d2, dimension combinations for the force transmitting member 13 and of the various snap acting forces for member 12, an unusually large number of force-displacement characteristics may be readily obtained and the discrete snaps at distinctly different force levels may be matched to a particular application. By way of illustration, assume member 12 is a circular snap acting disc, built from stainless steel, having a one inch nominal diameter and a thickness of 14 mils. Assume further that force transmitting member 13 has a diameter d1 of 0.35 inch and d2 of 0.65 inch, then the force-displacement curve of the type seen in FIG. 4 would have the following approximate values set out in the chart below:

| Positions On Curve | Extent Of Movement Of Member 13 (In Mils) | Applied Force On Member 13 In Pounds (Identity Of Position) |
|---|---|---|
| O-A | 10 | 17 (A) |
| A-B | 4 | 20 (B) |
| B-C | 6 | 17 (C) |
| C-D | 1 | 18 (D) |
| D-E | less than 1 | 19 (E) |
| E-F | 4 | 26 (F) |
| F-G | 4 | 18 (G) |
| G-H | 2 to 3 | 26 (H) |

If the diameter of d1 is increased to 0.45 inch while d2 is retained at 0.65 inch, the force at point A would increase from 17 to about 19 pounds while the force at point B would change from 20 to in the order of 23. The other forces would remain the same. On the other hand, if d2 were increased to 0.70 inch while d1 is held at 0.35 inch, it would be expected that the force at F would be 32 pounds rather than 26 and 22 rather than 18 at G. For best operation the force level at point A should be different than and preferably less than the force level at point G. This will tend to insure multiple and discrete snap actions. Generally speaking, the larger are dimension d1 or d2, the greater will be the force level. Thus, the different force levels can be preselected and independently controlled and two snaps of different preselected magnitudes from a single unit are attainable to facilitate selective operation of the two switches 16, 17 at different settings.

While force transmitting member 13 primarily determines the separate and distinct force levels at which snap acting member 12 functions within the designed snap acting force capabilities of member 12, the force adjusting means may be utilized to calibrate and further augment the control of these forces. By turning screw 119 to force depending section 118 of strap 112 in a direction toward snap acting member 12, the force applied to member 12 via strap 112 is regulated generally in opposition to the successive discrete snap acting movements of member 12. The calibrating force is applied such that it has a greater affect during the successive discrete snap action movements of member 12 between its unstable configurations (e.g., shown in FIGS. 6 and 7) than between its stable configuration (FIGS. 1 and 5) and one of the unstable configurations already identified.

Figure 8:
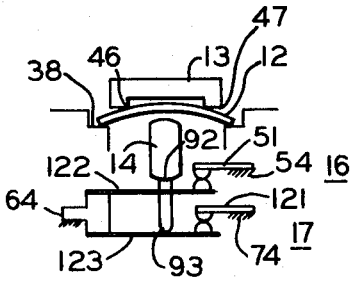
FIG. 8 is a schematic illustration of the upper and lower switches (as viewed in the drawings) for the device illustrated in FIG. 1 in another form, with the components of FIG. 8 being in the stable configuration.

FIG. 8 reveals a modified arrangement of switch elements in a schematic representation for switches 16, 17 where similar parts are identified by the same reference characters. For the sake of simplicity and brevity of description it should be observed that the switch elements are basically the same as those shown by FIGS. 1 and 2, the switches being of the normally closed circuit types, except that the movable contact element in the switches takes the form of a pair of cantilever mounted spring like elements 122, 123 in series circuit with each other and fixedly mounted in spaced apart relation for cantilever movement at terminal post location 64. In lower switch 17 element 123 is in make and break relation with respect to fixed contact element 121. The components are illustrated with the snap acting member 12 being in the stable configuration mode and operation is similar to that already discussed in connection with FIGS. 1–7 inclusive.

Figure 9:
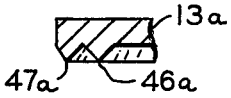
FIG. 9 is a view, partly in section and partly broken away, of a portion of a modification of the force transmitting part of the device illustrated in FIG. 1.

It will be recognized from the foregoing that the present invention may incorporate switching assemblies other than those illustrated and described, and device 11 is not limited to use of those assemblies. It should also be appreciated that force transmitting means 13 may take other forms and by way of example only FIG. 9 shows a modification identified as **13*a*. Member 13*a* has the inner and outer annular pressure applying portions 46*a*, 47*a* forming angular regions each inclined circular planes which form two well defined pressure applying circumferential edges spaced apart a predetermined distance. In this design angular pressure applying portions are supplied with predetermined dimensional relationships to establish, like member 13**, the magnitude of preselected and generally independent forces at which the snap acting means will operate with a snap type action at each point of operation.

It will thus be appreciated from the foregoing that the present invention provides many advantageous features and benefits. Among other things, a rugged, yet economical and relatively simple multiple circuit controlling device is furnished with an improved method of operation. A range of forces necessary to effect at least two discrete snap acting operations in a snap acting arrangement are provided which facilitates the independent actuation of at least two switches at different settings. Futhermore, satisfactory multiple circuit control is possible for a number of different applications. For example, illustrated device 11 is capable of use in a variety of demanding applications, for instance, in the air conditioning system of a vehicle to control opening and closing a fan circuit as well as switching the fan between two or more speeds of operation. In addition, the arrangement has an enhanced life expectancy with reliable operation due to the force characteristics capable of being built into it.

It should be apparent to those skilled in the art, while I have shown and described what at present are considered to be the preferred embodiments of my invention in accordance with the patent statutes, changes may be made without actually departing from the true spirit and scope of this invention, and I therefore intend to cover in the following claims all such equivalent variations as fall within the invention.

What I claim as new and desire to secure by Letters Patent of the United States is:

1. An electric circuit device comprising a housing having a fluid chamber and a switch chamber; a plurality of movable and fixed switch elements mounted in said switch chamber to define at least first and second switches each having selectively a closed and open circuit position; a snap acting member disposed in said housing for selectively operating said first and second switches; a switch actuator mounted for movement in said switch chamber with one section disposed in the vicinity of said snap acting member and another section in operative engagement with said movable switch elements of said first and second switches; and a piston movably carried in said housing having one section in pressure receiving relation to said fluid chamber and having another section disposed in force transmitting relation to said snap acting member, said another section of said piston including a first angular region for applying a first preselected force at a first location on said snap acting member to effect snap acting movement thereof to operate said first switch through said switch actuator selectively between the closed and open circuit positions, said another section of said piston further including a second angular region formed in spaced relation to said first angular region for applying a second preselected force of greater magnitude than the first preselected force at a second location on said snap acting member spaced outwardly from the first location to produce snap acting movement thereof to operate said second switch through said switch actuator selectively between the closed and open circuit positions, whereby said snap acting member produces two discrete snap acting movements at different preselected force levels to attain selective operation of said at least first and second switches.

2. The electric circuit controlled device of claim 1 in which said another section of said piston is an enlarged annulus having inner and outer annular pressure applying portions forming respectively said first and second angular regions.

3. The electric circuit controlling device of claim 1 in which the dimensional relationships of said first and second angular regions are predetermined to establish the magnitude of the preselected forces at which said snap acting member operates.

4. The electric circuit controlling device of claim 1 in which means is mounted in said housing for adjusting the magnitude of at least one of the preselected forces of said snap acting member.

5. An electric circuit controlling device comprising:

a housing;

snap action means disposed in said housing and adapted for successive discrete snap action movements from a stable configuration toward two unstable configurations thereof, respectively;

a pair of means operable generally for switching between two circuit controlling modes, respectively;

actuating means operable generally in response to the successive discrete snap action movements of said snap action means from the stable configuration toward the two unstable configurations thereof for selectively operating the pair of switching means between the circuit controlling modes thereof respectively; and force transmitting means having at least two different force applying portions selectively associated in operating engagement with said snap action means to cause the successive discrete snap action movements from the stable configuration toward the two unstable configurations thereof at different force levels so as to effect the operation of said actuating means and the selective actuation of said pair of switching means between the circuit controlling modes thereof, respectively.

6. The electric circuit controlling device of claim 5 in which said at least two different force applying portions are formed by an annulus having spaced apart inner and outer annular pressure applying regions.

7. The electric circuit controlling device of claim 5 in which the dimensions of said at least two different force applying portions are predetermined to effect the different force levels causing the successive discrete snap action movements from the stable configuration toward the two unstable configurations.

8. The electric circuit controlling device of claim 5 in which means is mounted in the housing for adjusting the magnitude of at least one of the two different force levels.

9. An electric circuit controlling device comprising a housing, a snap acting member and first and second switches each having open and closed circuit positions mounted in said housing; a switch actuator movably disposed in said housing in operative engagement between said snap acting member and selectively with said first and second switches, a force transmitting member having first and second pressure applying portions spaced apart a predetermined distance selectively in operating engagement with said snap acting member to produce two discrete snap actions with different force levels by said snap acting member on said switch actuator thereby selectively operating said first and second switches independently between open and closed circuit positions, respectively.

10. The electric circuit controlling device of claim 9 in which said first and second pressure applying portions are formed by an annulus having two annular regions and the two discrete snap actions with different force levels are related to the predetermined distance.

11. The electric circuit controlling device of claim 9 in which turnable means is mounted in said housing for calibrating the different force levels, with said pressure applying portions having a greater effect on the force levels than said turnable means.

12. A device comprising:

a housing;

snap action means disposed in said housing and adapted for successive discrete snap action movements at least at two different force levels from a stable configuration toward a pair of unstable configurations thereof; and adjustably movable means in said housing and associated with said snap action means for adjusting the at least two different force levels of the snap action movements of said snap action means, with the adjustment by said adjustably movable means of one of the at least two force levels being greater than the adjustment of another of the at least two force levels.

13. The device of claim 12 having pressure applying means for applying a first preselected force at a first location on said snap action means to effect snap acting movement thereof and for applying a second preselected force of a different magnitude than the first preselected force at a second location on said snap action means in spaced relation to the first location, said pressure applying means having a greater affect in determining the first and second preselected force levels respectively than said adjustably movable means.

14. The device in claim 12 in which the adjustably movable means includes a spring member having a depending section, and a turnable member having one end in engagement with said depending section for changing the deflection thereof to produce different magnitudes of adjustments of the respective force levels of the snap action movements.

15. A method of operating a snap action member through successive discrete snap action movements from a stable configuration of the snap action member toward a plurality of unstable configurations thereof, the snap action member having a peripheral portion seated at least in part in engagement with a seat provided therefor in a housing, the method comprising the steps of:

exerting an applied force at a preselected level onto the snap action member;

moving the snap action member in response to the applied force at the preselected level exerted thereon through one of the discrete snap action movements of the snap action member from its stable configuration toward one of the unstable configurations thereof;

increasing the applied force exerted on the snap action member to another preselected level greater than the first named preselected level; and further moving the snap action member in response to the applied force at the another preselected level exerted thereon through another of the discrete snap action movements of the snap action member from its one unstable configuration toward another of the unstable configurations thereof.

16. The method as set forth in claim 15 wherein the increasing step includes changing the location at which the applied force is exerted on the snap action member at the another preselected level from the location at which the applied force is exerted on the snap action member at the first named preselected level.

17. The method as set forth in claim 15 wherein the further moving step includes disengaging the peripheral portion of the snap action member from the housing seat and engaging another portion of the snap action member at least in part with the housing seat.

18. The method as set forth in claim 15 comprising the preliminary step of applying a calibration force onto the snap action member generally opposing the one and another discrete snap action movements thereof and with the calibration force having a greater affect during the another discrete snap action movement of the snap action member than during the one discrete snap action movement thereof.

19. A method of operating a snap action member through successive discrete snap action movements thereof from a stable configuration of the snap action member toward a plurality of unstable configurations thereof and with the snap action member being seated at least in part against a seat provided therefor in a housing, the method comprising the steps of:

moving the snap action member in response to an applied force at a preselected level exerted thereon through one of the successive discrete snap action movements of the snap action member from its stable configuration to one of the unstable configurations thereof and thereafter actuating the snap action member through another of its successive discrete snap action movements from the one unstable configuration toward another of the unstable configurations thereof when the applied force exerted on the snap action member is increased to another preselected level.

20. A method of calibrating successive discrete snap action movements of a snap action member from a stable configuration thereof toward a plurality of unstable configurations thereof, the snap action member being seated at least in part against an associated seat provided therefor in a housing, the method comprising the steps of:

applying a calibration force against the snap action member generally in opposition to its successive discrete snap action movements with the calibration force having a greater affect during the discrete snap action movement of the snap action member between its unstable configurations than during the discrete snap action movement of the snap action member between its stable configuration and one of the unstable configurations thereof.

21. An electric circuit controlling device comprising:

a housing;

snap action means disposed in said housing and adapted for successive discrete snap action movements from a stable configuration toward a plurality of unstable configurations thereof, respectively;

means operatively associated with said snap action means for switching between a plurality of circuit controlling positions upon the successive discrete snap action movements of said snap action means toward the unstable configurations thereof; and means operable generally for transmitting a force at different force levels onto said snap action means to effect the successive discrete snap action movements of said snap action means toward the unstable configurations thereof.

22. The device as set forth in claim 21 wherein said transmitting means includes a plurality of different force applying portions selectively associated at the different force levels with said snap action means to cause the successive discrete snap action movements of said snap action means toward the unstable configurations thereof.

23. The device as set forth in claim 21 further comprising means associated with said snap action means in said housing and operable generally for adjusting the magnitude of at least one of the different force levels.

24. An electric circuit controlling device comprising:

a housing;

snap action means adapted for at least one snap action movement at at least one force level from a stable configuration toward at least one unstable configuration thereof and including a generally circumferential portion seated in said housing, and a generally central portion at least in part integral with said circumferential portion; and resilient means for adjusting the magnitude of at least the at least one force level of the at least one snap action movement of said snap action means from the stable configuration toward the at least one unstable configuration thereof, said resilient means including an intermediate section engaged with said snap action means at least generally adjacent said central portion thereof, and a pair of generally opposite end sections integral with said intermediate section, one of said opposite end sections being seated in said housing at least generally adjacent said circumferential portion of said snap action means, and the other of said opposite end sections being adjustable to exert an adjusting force through at least said intermediate section against said snap action means to establish the magnitude of at least the at least one force level of the at least one snap action movement of said snap action means from the stable configuration toward the at least one unstable configuration thereof.

25. The device as set forth in claim 24 further comprising adjustable means associated with said housing and said other opposite end section of said resilient means for applying the adjusting force onto said other opposite end section of said resilient means.

26. The device as set forth in claim 24 further comprising means operable generally for transmitting a force at the at least one force level onto said snap action means to effect the at least one snap action movement of said snap action means from the stable configurations toward the at least one unstable configuration thereof against the adjusting force exerted on said snap action means by said resilient means.

27. The device as set forth in claim 26 wherein said transmitting means includes a pair of different force applying means adapted for selective association with said snap action means, respectively, one of said different force applying means being selectively associated with said snap action means to effect the at least one snap action movement of said snap action means from the stable configuration toward the at least one unstable configuration thereof at the at least one force level and the other of said different force applying means being selectively associated with said snap action means to effect another discrete snap action movement of said snap action means from the at least one unstable configuration toward another unstable configuration thereof at another force level greater than the at least one force level, and the adjusting force exerted by said resilient means against said snap action means being effective to establish the magnitude of at least one of the at least one force level and the another force level.

* * * * *